US007086253B2

(12) United States Patent
Simmendinger et al.

(10) Patent No.: US 7,086,253 B2
(45) Date of Patent: Aug. 8, 2006

(54) NEEDLE FOR A LOOP-FORMING SYSTEM

(75) Inventors: Roland Simmendinger, Strassberg (DE); Kurt Wiedenhöfer, Albstadt (DE); Manfred Sauter, Stetten am kalten Markt-Storzingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/183,986

(22) Filed: Jul. 19, 2005

(65) Prior Publication Data

US 2006/0016227 A1 Jan. 26, 2006

(30) Foreign Application Priority Data

Jul. 23, 2004 (EP) ..... 04017486

(51) Int. Cl.
*D04B 35/06* (2006.01)
*D04B 35/04* (2006.01)

(52) U.S. Cl. ..... 66/120; 66/121

(58) Field of Classification Search ..... 66/117–123
See application file for complete search history.

(56) References Cited

U.S. PATENT DOCUMENTS

| | | | | |
|---|---|---|---|---|
| 1,391,043 | A | 9/1921 | Burson | |
| 4,423,606 | A | 1/1984 | Hofmann | |
| 5,216,901 | A * | 6/1993 | Okada | 66/120 |
| 6,457,333 | B1 | 10/2002 | Shelton | |

FOREIGN PATENT DOCUMENTS

| | | |
|---|---|---|
| DE | 29 09 963 | 9/1980 |
| WO | WO-00/34560 | 6/2000 |

* cited by examiner

*Primary Examiner*—Danny Worrell
(74) *Attorney, Agent, or Firm*—Fitch, Even, Tabin & Flannery; Norman N. Kunitz

(57) ABSTRACT

A needle (1), in particular a machine knitting needle, for instance for use in circular knitting machines, has a closing member (4), which is supported both pivotably and longitudinally displaceably. The motion of the closing member is controlled externally by a control element (5). The needle (1) of the invention makes do with especially short working strokes, both for the needle (1) and for the control element (5). It is sturdy, and among other purposes it is suitable for especially fine pitches and for higher number of systems in circular knitting machines.

19 Claims, 5 Drawing Sheets

1
2
3
4
5
6
7
8
9
11
12
13
14
15
16
17
18
19
21
22
23
24
25
26
27
28
29
31
L

NEEDLE FOR A LOOP-FORMING SYSTEM

CROSS REFERENCE TO RELATED APPLICATION

This application claims the priority of European Patent Application No. 04 017 486.4, filed on Jul. 23, 2004, the subject matter of which, in its entirety, is incorporated herein by reference.

FIELD OF THE INVENTION

The invention relates to a needle for a loop-forming system, in particular for a knitting system.

BACKGROUND OF THE INVENTION

As a rule, needles for loop-forming systems, such as knitting machine needles, have a basic body with a shank and a hook embodied on the shank; the hook interior can be opened and closed by a suitable closing member. As closing members, pivotably supported latches or closing elements are used, which are longitudinally displaceably supported on the needle. The closing element of a compound needle is provided with a butt that is in engagement with a cam, so that the opening and closing motion can be performed in a controlled fashion. In the process, the closing element executes a stroke of considerable length.

Latch needles exist in which the latch is freely movably supported. Latch needles are furthermore known in which the latch motion is controlled by a control slide. One such latch needle is known from International Patent Disclosure WO 00/34560. This latch needle has a closing member embodied as a toggle lever, one arm of which forms a closing portion while the other arm is in communication with a control slide and thus forms a control portion. Depending on the position of the closing element, the closing portion can be shifted into a first position, in which it is located outside the hook and uncovers the interior. In another sliding position, the tip of the control portion is located precisely at the tip of the hook. In a further sliding position, the closing portion is located in a notch, embodied on the base of the hook, and thus also uncovers the hook. However, the majority of the closing portion protrudes out of the notch.

This needle requires a slotted hook tip, to enable the closing portion to move through the hook tip. The result is extremely pointed and hence sharp-edged structure on the tip of the hook. Moreover, there is the risk that even if there is the slightest lateral play, the closing portion on passing through the forked hook tip will strike the hook tip or become caught or scrape it. This precludes the use of this principle in needles that are intended for an especially fine pitch.

With this as the background, it is the object of the invention to create a needle with an externally controlled closing member. As much as possible, this control member should make do with a short-stroke actuating motion.

SUMMARY OF THE INVENTION

The above object is attained by the needle according to the invention for a loop-forming system, in particular for a knitting system, which needle comprises a needle body having a hook formed at one end, and a closing member, which is supported displaceably on the needle body and also pivotably in at least one sliding position.

The needle of the invention is intended for knitting systems and is also suitable for use in other loop-forming systems (knitting machines) or in circular knitting machines, for instance. The closing member can execute both a pivoting motion and a sliding motion independently of one another. With the combined sliding and pivoting motion, it is successfully possible to open and uncover the hook interior completely; all that is needed is a combined short closing member translation motion and a slight closing member pivoting motion. For that purpose, a short motion of a control sinker or of some other control element suffices. The actuation stroke of the control element is shorter than in a compound needle. This is achieved by providing that the closing member has two degrees of freedom of motion. In that sense, it is movable two-dimensionally, or in other words with two motion components.

It is also successfully possible, with the pivoting motion, to sink the closing member into a slot adjacent to the hook, so that the loop located in the hook can be transferred to the closing member with a short-stroke motion. Thus the needle of the invention, in forming loops, requires shorter axial strokes than is the case in conventional compound needles or even conventional latch needles.

Because of the axial translational motion of the closing member, no overlaps occur between the movement curve of the end of the closing member and the hook. The hook tip need not be forked. Nevertheless, the closing member can stay both in a position below the hook tip and in a position above the hook tip. This opens up the possibility of miniaturizing the needle, making extremely fine pitches attainable. Moreover, high operating speeds as well as higher numbers of systems (for instance in circular knitting) are attainable.

It is considered advantageous if the closing member is a closing element that has a closing portion, and the needle body has a receiving slot into which the closing portion can penetrate, uncovering the hook interior. If the closing portion is at least intermittently received entirely by the hook interior, then a loop located in the hook interior can slide unhindered, for instance as far as a contact shoulder located near the hook, and the loop is then taken over by the closing member when the closing member pivots out of the receiving slot.

The closing member is preferably provided with a control portion that is in engagement with a control element. The control element is for instance a control sinker, whose motion is controlled by a cam. However, the option of putting the control portion directly into engagement with a cam can also be considered.

The control sinker is preferably supported displaceably with respect to the longitudinal direction of the needle, and it can furthermore be pivotably supported, in order to move away from the needle or to approach it. The motion of the control sinker then has two components. This motion can be utilized, in conjunction with a controllable coupling means, to switch over between a translational motion and a pivoting motion of the closing member. The controllable coupling means may be formed for instance by a forklike embodiment of the control sinker, on the one hand, and by two contact means, provided on the control portion of the closing member and spaced apart from one another, of which depending on the position of the control sinker, selectively only the outer one or both of them are located in the forklike recess.

It is also considered advantageous to support the closing member in a sliding block guide. The sliding block guide includes for instance a latch slot, embodied on the closing member, that has a more or less straight portion for defining the translational motion and also has a lateral branch. The sliding block guide further includes a bearing means (axle, shaft, journal) that reaches transversely through the applicable slot of the closing member. The lateral branch of the latch slot of the closing member can serve as a hinge bearing for the pivoting motion of the closing member. To promote the latching of the axle in the lateral branch, a spring element may be provided on the needle. This spring element is preferably oriented and disposed such that it pre-stresses the closing element for the latching of the lateral branch on the axle.

In an alternative embodiment, the sliding block guide can conversely be embodied such that the slot for the longitudinal guidance of the closing element is embodied along with the lateral branch on the needle, while the closing member engages this slot with a corresponding protrusion. Corresponding slots may be embodied on both sides of the closing member in corresponding cheeks of the needle, between which the closing member is held. Protrusions protruding away from the flat sides of the closing member then run into these slots.

Further details of advantageous embodiments are the subject of the drawings, description, or claims.

One exemplary embodiment of the invention is shown in the drawing.

DETAILED DESCRIPTION OF THE INVENTION

Figures 1, 2:
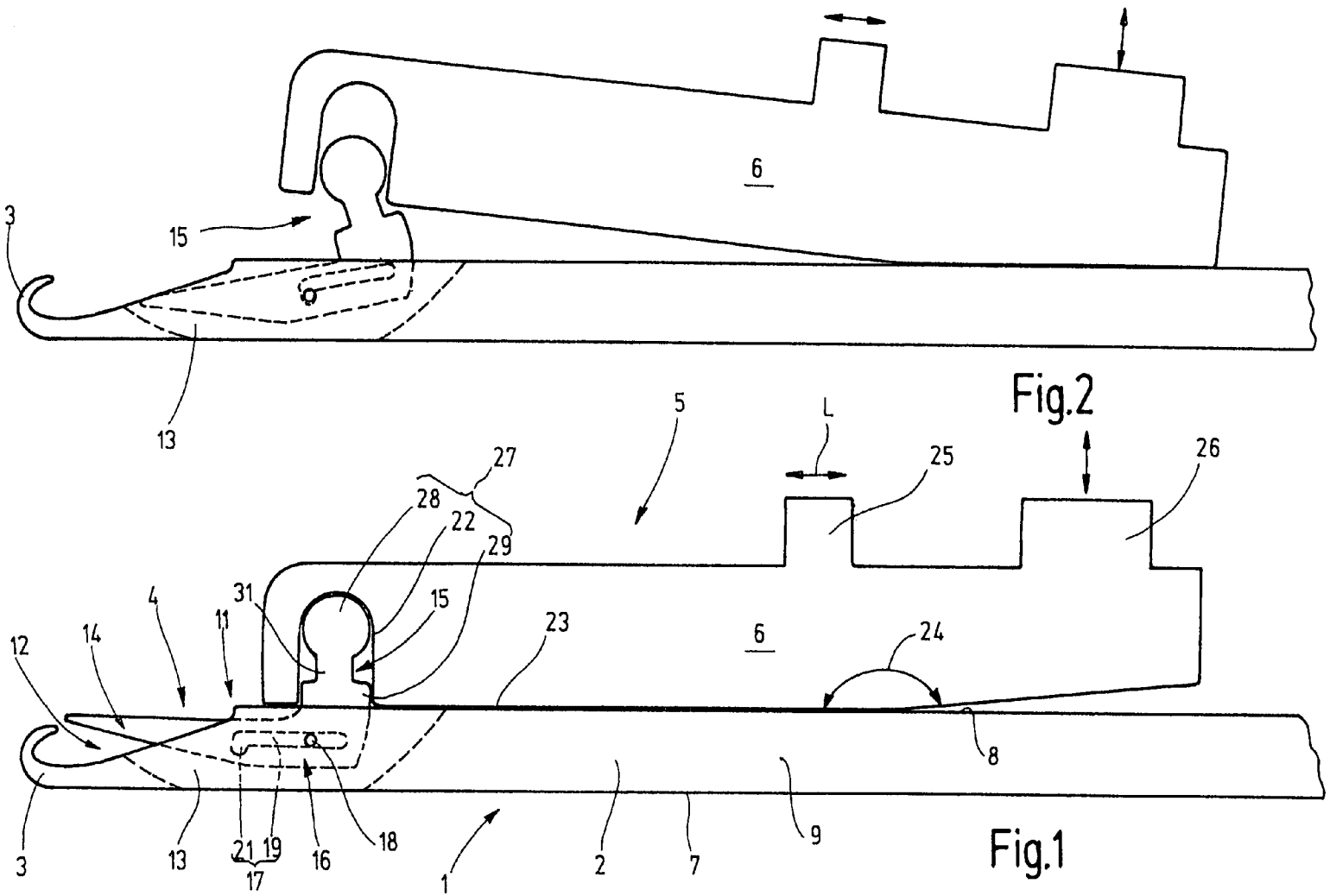
FIG. 1 is a schematic side view showing the needle of the invention along with the closing member and control element in the translation position.
FIG. 2 is a schematic side view of the needle of FIG. 1 with the control sinker in the pivoted position.

In FIG. 1, a needle 1 is shown, which may be provided as a machine knitting needle, for instance in a circular knitting machine. The needle 1 includes a needle body 2 with a hook 3 embodied on its end and with a closing member 4 supported on the needle body 2. As a control element 5, a control sinker 6 is also associated with the needle 1.

The needle body 2 is a flat body, for instance with a straight, narrow needle back 7, a likewise narrow, straight needle top 8, and preferably flat side faces extending between them, of which only one side face 9 is visible in FIG. 1. Beginning at this substantially uniform cross section of the needle body 2, the needle body has a shoulder 11, in the vicinity of the hook 3, from which the height of the needle body 2 decreases as far as the hook 3. The entire space defined by the hook 3 and the shoulder 11 serves the purpose of loop formation. It will be called the hook chamber 12 here.

The needle body 2 is provided with a slot 13, which begins approximately in the middle of the hook chamber 12 and extends away from the hook 3 past the shoulder 11. The slot 13 is defined by two flat cheeks that are part of the needle body 2. The closing member 4, which is embodied on the order of a toggle lever, is seated in the slot 13. One arm of this lever forms a closing portion 14, while the other arm forms a control portion 15.

A sliding block guide 16 serves to support the closing member 4 in the slot 13 and includes a guide slot 17, embodied in the closing member 4, and an axle 18 that passes transversely through the closing member 4 in the guide slot 17. The guide slot 17 is subdivided into a preferably substantially straight guideway 19, oriented approximately parallel to the closing portion 14, and a lateral branch 21 that preferably adjoins one end of the guideway 19. In the present preferred exemplary embodiment, the lateral branch 21, at the front end, that is, the end closest to the hook 3, branches from the guideway 19 in the direction of the needle back 7. The lateral branch 21 and the guideway 19 preferably have a width that except for a slight play matches the diameter of the axle 18.

The control portion 15 is in engagement with the control sinker 6. For that purpose, the control sinker has a forklike recess 22. The control sinker 6 is a flat body whose thickness essentially matches the thickness of the needle body 2. With its narrow underside 23, the control sinker 6 rests on the needle top 8. The underside 23 has an obtuse angle 24, for instance, which permits tilting of the control sinker 6 between the position shown in FIG. 1 on the one hand and the position shown in FIG. 2 on the other. The control sinker 6 can thus rock back and forth between two positions. Both for defining the rocking position and for the sake of axial displacement with respect to the longitudinal direction L of the needle, one or more control butts 25, 26 may be embodied on the control sinker 6; they are in engagement for instance with a needle cam of a knitting machine and thus cause the motion of the control sinker 6. The needle 1 is moreover also in engagement, via a butt not further shown, for instance with the cam of a knitting machine.

With a corresponding contour of the control portion 15, the recess 22 forms a coupling means 27, which besides the recess 22 also includes a head 28, embodied on the control portion 15 and in disklike shape in side view, and a rectangular portion 29 spaced apart from the head 28. Between the rectangular portion 29 and the head 28, a narrower web 31 is formed. The width of the rectangular portion matches the diameter of the head 28. This dimension is designed such that both the head 28 and the rectangular portion 29 fit with slight play into the recess 22.

Figure 3:
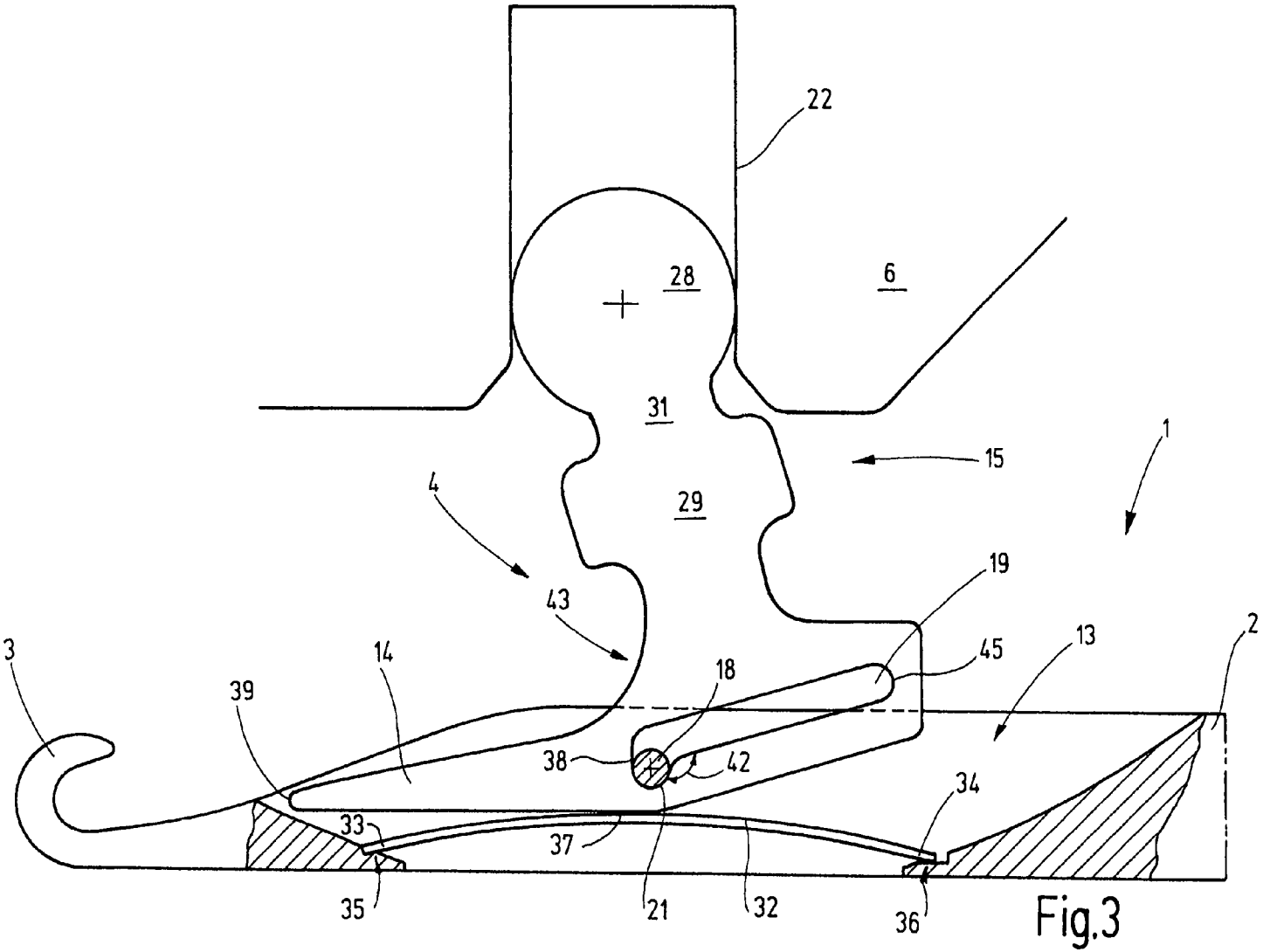
FIG. 3, in a partly sectional side view, shows the needles of FIG. 2 in somewhat more detail and schematically, larger but not to scale.

FIG. 3 illustrates further details. In it, a spring 32 is accommodated in the slot 13 and is embodied as a narrow leaf spring that is movable in the latch slot 13. With its two ends 33, 34, it is braced in corresponding seats 35, 36 that are embodied in the latch slot 13. It is curved toward the axle 18, and this axle is located approximately centrally above the spring 32. With its middle portion 37, the spring presses against the closing member 4 from below.

The needle 1, described thus far in its basic details, also has the following special features, which can be seen in particular in FIG. 3:

The length of the closing portion 14, measured between the front end 38 of the guideway 19, or the lateral branch 21, and the front end 39 of the closing portion 14, is less than the spacing of the axle 18 from the front end, toward the hook, of the latch slot 13. As a result, the closing portion 14 can dip all the way into the slot 13. Moreover, the spacing between the end 39 and the rear end 45, that is, the end facing away from the hook 3, of the guideway 19 is greater than the spacing of the axle 18 from the tip of the hook 3 as can be seen by looking ahead to FIG. 4. In addition, the lateral branch 21 does not branch off from the guideway 19 at a right angle. Instead, an obtuse angle 42 is formed between the lateral branch 21 and the guideway 19. The lateral branch 21 is also preferably shorter than the diameter of the axle 18. It is thus attained that when the closing member 4 is given a longitudinal push by the control sinker 6, the axle 18 easily snaps out of the lateral branch 21.

The shoulder 11 may also disposed with. Its function can be taken over by a throat 43, embodied on the closing member 4 between the closing portion 14 and the rectangular portion 29.

Figure 4:
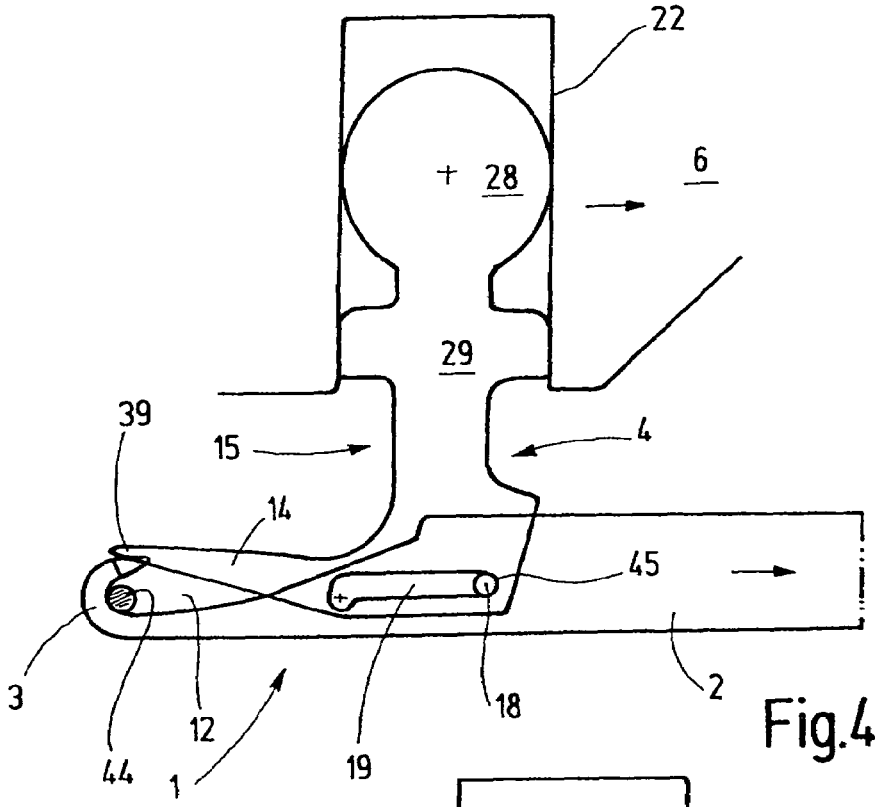
FIGS. 4 through 8 schematically show the needle of FIGS. 1 through 3 in various stages of operation, to illustrate the loop formation.

The needle 1 described thus far functions as follows, with reference to FIGS. 4 through 8:

FIG. 4 shows the needle 1 with a loop 44 in the hook 3 that has not yet been knocked over. The closing member 4 is in its farthest forward-advanced position. The axle 18 touches a rear end 45 of the guideway 19. The end 39 of the closing portion 14 rests on the tip of the hook 3. The closing member 4 is now held unpivotably. The control sinker 6 has moved so close to the needle body 2 that both the head 28 and the rectangular portion 29 are located in the recess 22. Thus control portion 15 cannot be pivoted counter to the sinker 6. An axial motion of the sinker 6 in the longitudinal direction L of the needle (FIG. 1) is transmitted as a sliding motion to the closing member 4.

Figure 5:
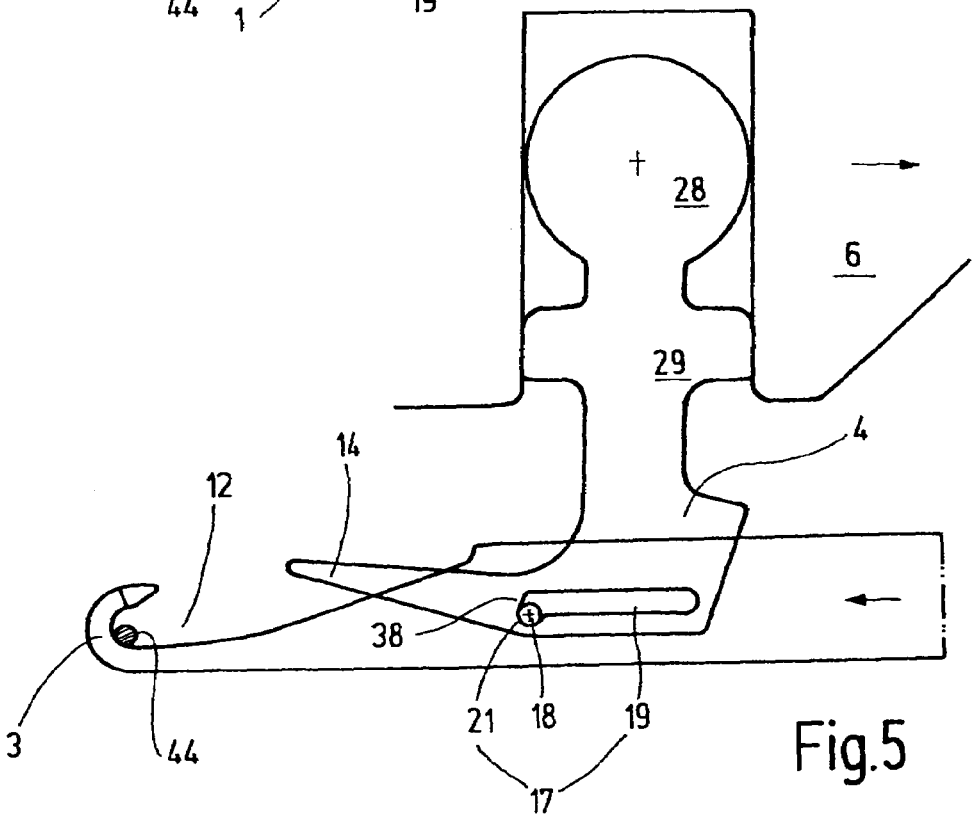

For opening the hook chamber 12, the control sinker 6 can be displaced away from the hook 3 relative to the needle body 2. The result of such a motion is shown in FIG. 5. The hook chamber 12 is now open, but the closing portion 14 still protrudes into the hook chamber 12. Once the front end 38 of the guideway 19 has arrived at the axle 18 (FIG. 5) as a result of the retraction of the control sinker 6, the spring 32, not further shown in FIGS. 4 through 6, presses the closing member 4 slightly upward, so that the lateral branch 21 of the guide slot 17 snaps into place on the axle 18.

Figure 6:
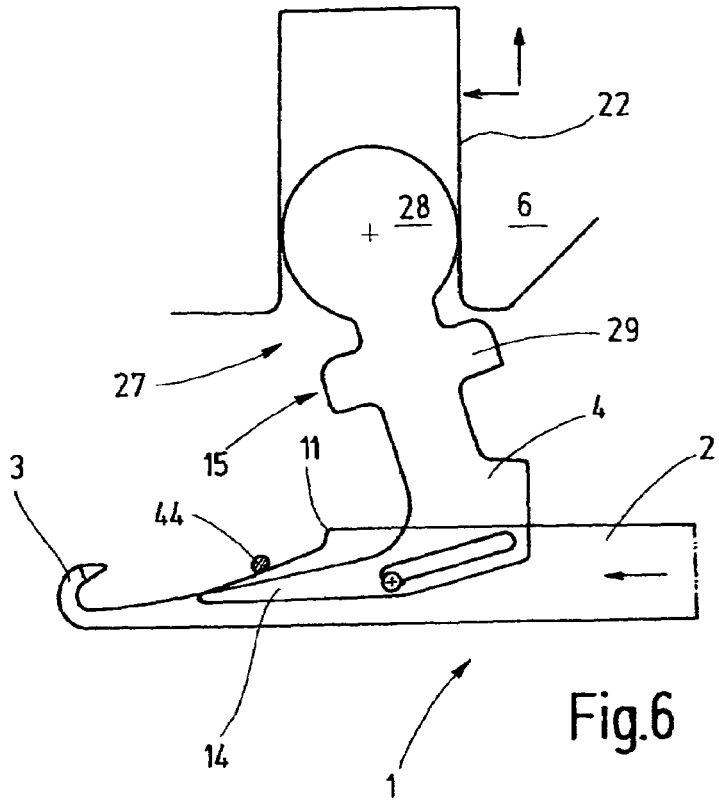

If the loop 44 is now supposed to be transferred to the back of the closing portion 14, the closing portion 14 is first plunged completely within the slot 13. To that end, the sinker 6, as FIG. 6 shows, is moved somewhat away from the needle 1, or in other words the needle body 2. The motion is just far enough that the head 28, but not the rectangular portion 29, is still seated in the recess 22. This can be accomplished for instance by the rocking motion of the control sinker 6, which can be seen by a comparison of FIGS. 1 and 2. Thus the coupling means 27 is switched over from a rigid coupling, which is fixed against relative rotation for transmitting the longitudinal sliding motion, to an articulated connection between the control portion 15 and the control sinker 6. If the control sinker 6 now, as FIG. 2 or FIG. 6 shows, experiences a short forward motion toward the hook 3, this causes the closing portion 14 to be sunk in the slot 13. The axle 18, which until now has served as a crosshead guide for the closing member 4, now becomes the center of pivoting of the closing member 4. The loop 44 can now, as FIG. 6 shows, slide for instance as far as the shoulder 11. It is then located above the closing portion 14.

Figure 7:
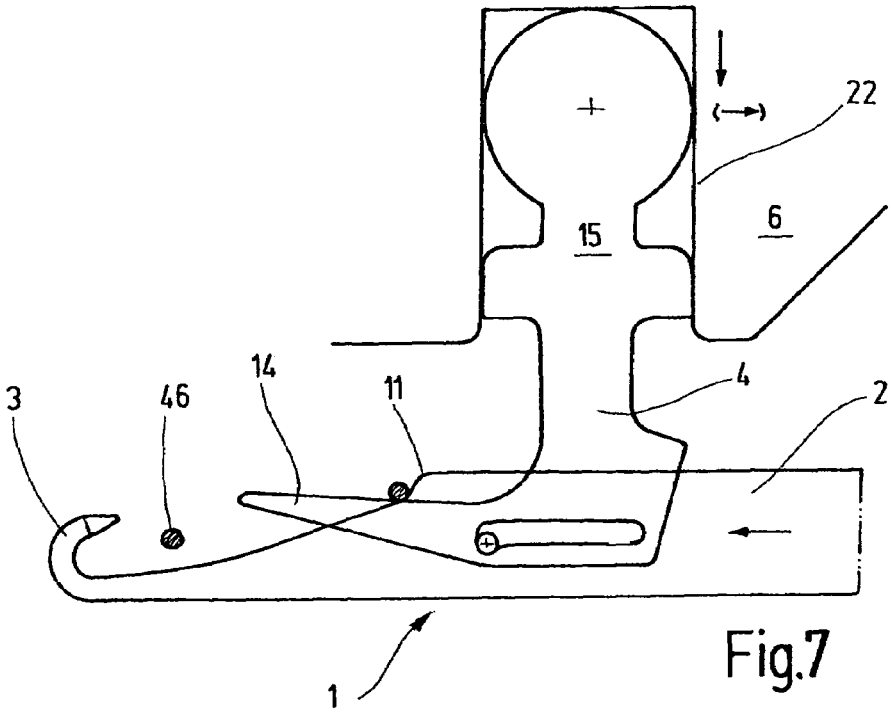
Figure 8:
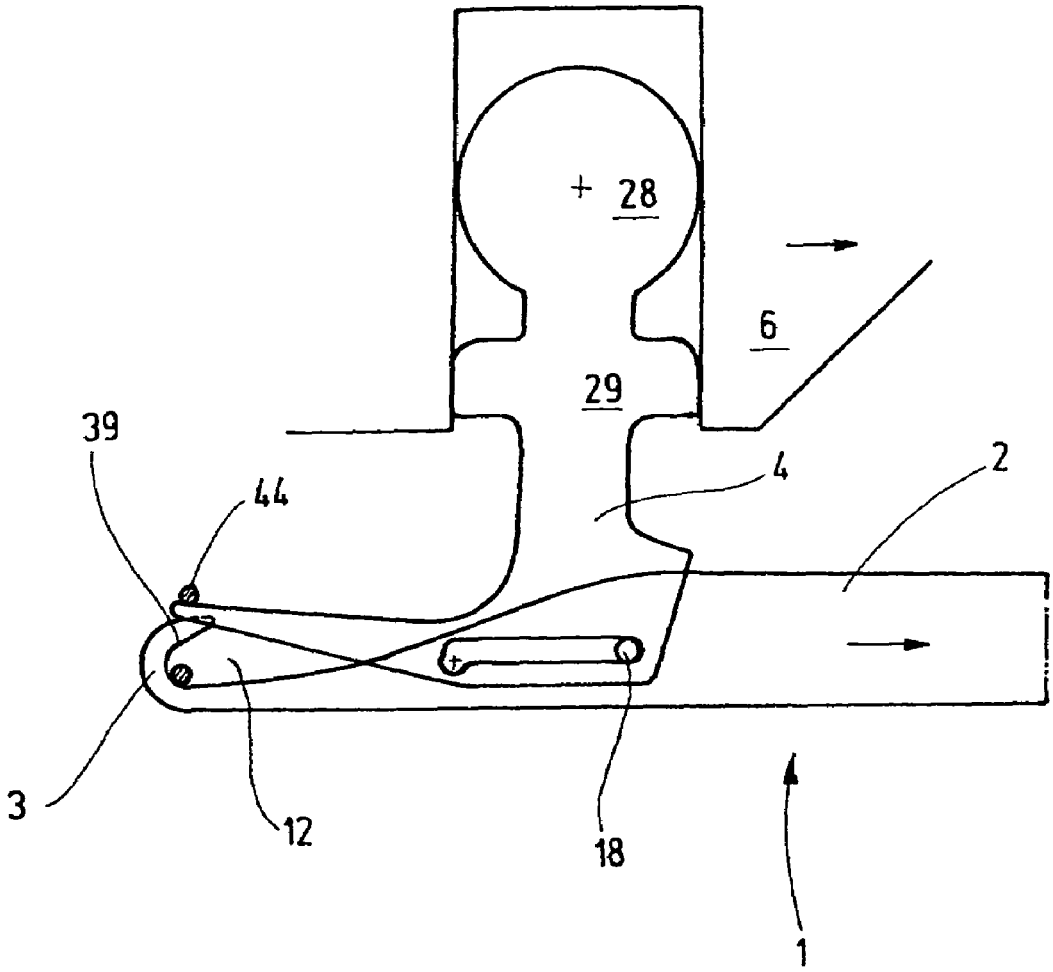

In the next step, shown in FIG. 7, the control sinker 6 is initially retracted, far enough that the longitudinal direction of the control portion 15 is approximately aligned with the longitudinal direction of the opening 22. In this pivoting motion of the control portion 15, the closing portion 14 is lifted out of the slot 13. The control sinker 6 can then, as FIG. 7 shows, be moved closer to the needle 1, so that the closing member 4 is again coupled to the control sinker 6 in a way fixed against relative rotation. In the meantime, the hook. 3 can have taken up a yarn 46 that has been newly put in place. If the control sinker 6 is now moved forward, that is, toward the hook 3, then finally the position shown in FIG. 8 is reached. The end 39 of the closing member 4 rests on the hook 3. The hook chamber 12 is closed. The loop 44 can slide over the hook 3. This is called knocking over.

In summary, the present invention comprises a needle 1, in particular a machine knitting needle, for instance for use in circular knitting machines, that has a closing member 4, which is supported both pivotably and longitudinally displaceably independently of one another. The motion of the closing member is controlled externally by a control element 5. The needle 1 of the invention makes do with especially short working strokes, both for the needle 1 and for the control element 5. It is sturdy, and among other purposes it is suitable for especially fine pitches and for higher numbers of systems in circular knitting machines.

It will be appreciated that the above description of the present invention is susceptible to various modifications, changes and adaptations, and the same are intended to be comprehended within the meaning and range of equivalents of the appended claims.

What is claimed is:

1. A needle for a knitting system comprising, a needle body, on the end of which a hook is embodied, and a closing member, which is supported on the needle body for sliding displacement in a longitudinal direction of the needle and also for independent pivotal movement about a transverse axle mounted on the needle body in at least one sliding position.

2. The needle according to claim 1, wherein the closing member has a closing portion, and the needle body has a slot into which the closing portion can dip, uncovering the hook chamber.

3. The needle according to claim 1, wherein the closing member has a control portion, which is in engagement with a control element.

4. The needle according to claim 3, wherein the control element is a control sinker.

5. The needle according to claim 4, wherein the control sinker is supported displaceably relative to the longitudinal direction (L) of the needle.

6. The needle according to claim 4, wherein the control sinker is supported movably toward and away from the needle.

7. The needle according to claim 4, wherein a controllable coupling means is disposed between the control sinker and the control portion.

8. The needle according to claim 1, wherein the closing member is supported by a sliding block guide.

9. The needle according to claim 8, wherein the sliding block guide has a straight guideway and a lateral branch, which together with, the axle that is supported by the needle body, serves as a pivot bearing for the closing member.

10. The needle according to claim 1, wherein the closing member is prestressed in a predetermined direction by a spring means.

11. A needle for a knitting system comprising:

a needle body having a hook formed on one end thereof; and a closing member, which is supported on the needle body via a sliding block guide for sliding displacement and also pivotally in at least one sliding position, with the sliding block guide having a straight guideway and a lateral branch, which together with a bearing means supported by the needle body, serves as a pivot bearing for the closing member.

12. A needle for a knitting system comprising:

a needle body having a hook formed on one end thereof, and a slot formed in the needle body adjacent the hook; and a closing member having a first end facing the hook, and an opposite end, which is provided with a longitudinally extending guide slot, extending into said slot formed in the needle body and supported on the needle body via an axel mounted on the needle body within the slot thereof and extending transverse to the longitudinal direction of the needle and the closing member through the guide slot, whereby the closing member is displaceable in the longitudinal direction of the needle and the closing member, and pivotal about said axel.

13. The needle according to claim 12 further comprising a laterally extending branch for said guide slot and into which said axel can move upon displacement of said closing member.

14. The needle according to claim 13 wherein said laterally extending branch is located at the end of said slot in said closing member facing the hook.

15. The needle according to claim 14 wherein said laterally extending branch extends in a direction toward a back of the needle body, and has a length less than the diameter of the axel.

16. The needle according to claim 15 wherein the laterally extending branch encloses an obtuse angle with the longitudinally extending guide slot.

17. The needle according to claim 15 wherein the width of said guide slot and of said laterally extending branch is substantially the same as the diameter of said axel.

18. The needle according to claim 16 further comprising a spring mounted in said slot in said needle body and biasing the closing member against said axel.

19. The needle according to claim 14 wherein the opposite end of said closing member is provided with a laterally extending control portion for engagement with an external control element for the controlling the displacement and the pivoting of the closing member.

* * * * *